US007624523B1

(12) United States Patent
Chen

(10) Patent No.: US 7,624,523 B1
(45) Date of Patent: Dec. 1, 2009

(54) DECORATIVE WATER BALL BASE SEAT

(76) Inventor: Tsan-Yao Chen, 2-1 Fl., No. 76, Sec. 3, Hsinsheng North Rd., Taipei City (TW)

( * ) Notice: Subject to any disclaimer, the term of this patent is extended or adjusted under 35 U.S.C. 154(b) by 0 days.

(21) Appl. No.: 12/342,086

(22) Filed: Dec. 23, 2008

(51) Int. Cl.
*G09F 19/00* (2006.01)

(52) U.S. Cl. ..... 40/409

(58) Field of Classification Search ..... 40/406–409
See application file for complete search history.

(56) References Cited

U.S. PATENT DOCUMENTS 4,176,469 A * 12/1979 Timco ..... 434/126
6,499,854 B2 * 12/2002 Chen ..... 362/101
2003/0140533 A1 * 7/2003 Liang ..... 40/409

* cited by examiner

*Primary Examiner*—Cassandra Davis
(74) *Attorney, Agent, or Firm*—Leong C. Lei

(57) ABSTRACT

A decorative water ball base seat is disclosed. The water ball is provided with a holding face provided with a slot corresponding to the number deformable rubber body of the water ball, for the fastening of the deformable rubber body characterized in that the deformable rubber body are made from rubber material and are provided with an engaging top edge to urge and to be fastened at the interior of the protruded edge of the engaging slot to provide compression resistant and sealing ability, and the interior of the rubber body is an integrally formed compressed section, thereby the compressed section absorbs or resist the pressure increase/decrease of the liquid contained in the water ball.

1 Claim, 4 Drawing Sheets

DECORATIVE WATER BALL BASE SEAT

TECHNICAL FIELD OF THE INVENTION

The present invention relates to a decorative water ball and the base seat for holding the water ball.

DESCRIPTION OF THE PRIOR ART

Decorative water ball contains liquid and the liquid expands when the surrounding temperature increases, and the liquid contracts when the surrounding temperature decreases. The rotating shaft of the base seat holding the water ball is mounted within the center of the water ball, the expansion and contraction of the liquid causes water leakage. In order to prevent water leakage, a sealing rim has to be mounted between the rotating shaft and the hole for the shaft.

The drawback of the conventional base seat is that the change of surrounding temperature will cause the water to leak and the rotating of the water ball is affected. If a bigger rim is employed on to the shaft, the rotating shaft may not rotate smoothly as a result of the frictional force caused by the rim.

Accordingly, it is an object of the present invention to provide a decorative water ball base seat which mitigates the above drawback.

SUMMARY OF THE INVENTION

An object of the present invention is to provide a decorative water ball base seat having a holding face provided with a slot corresponding to the number deformable rubber body of the water ball, for the fastening of the deformable rubber body characterized in that the deformable rubber body are made from rubber material and are provided with an engaging top edge to urge and to be fastened at the interior of the protruded edge of the engaging slot to provide compression resistant and sealing ability, and the interior of the rubber body is an integrally formed compressed section, thereby the compressed section absorbs or resist the pressure increase/decrease of the liquid contained in the water ball.

Yet another object of the present invention is to provide a decorative water ball base seat, wherein the deformable rubber body has one or more than one holding face(s).

Still a further object of the present invention is to provide a decorative water ball base seat, wherein the engaging slot of the rubber body is further adhered using an adhesive to prevent leakage.

Other objects, and advantages will become more apparent in view of the following detailed description in conjunction with the accompanying drawings.

DETAILED DESCRIPTION OF THE PREFERRED EMBODIMENTS

Figure 1:
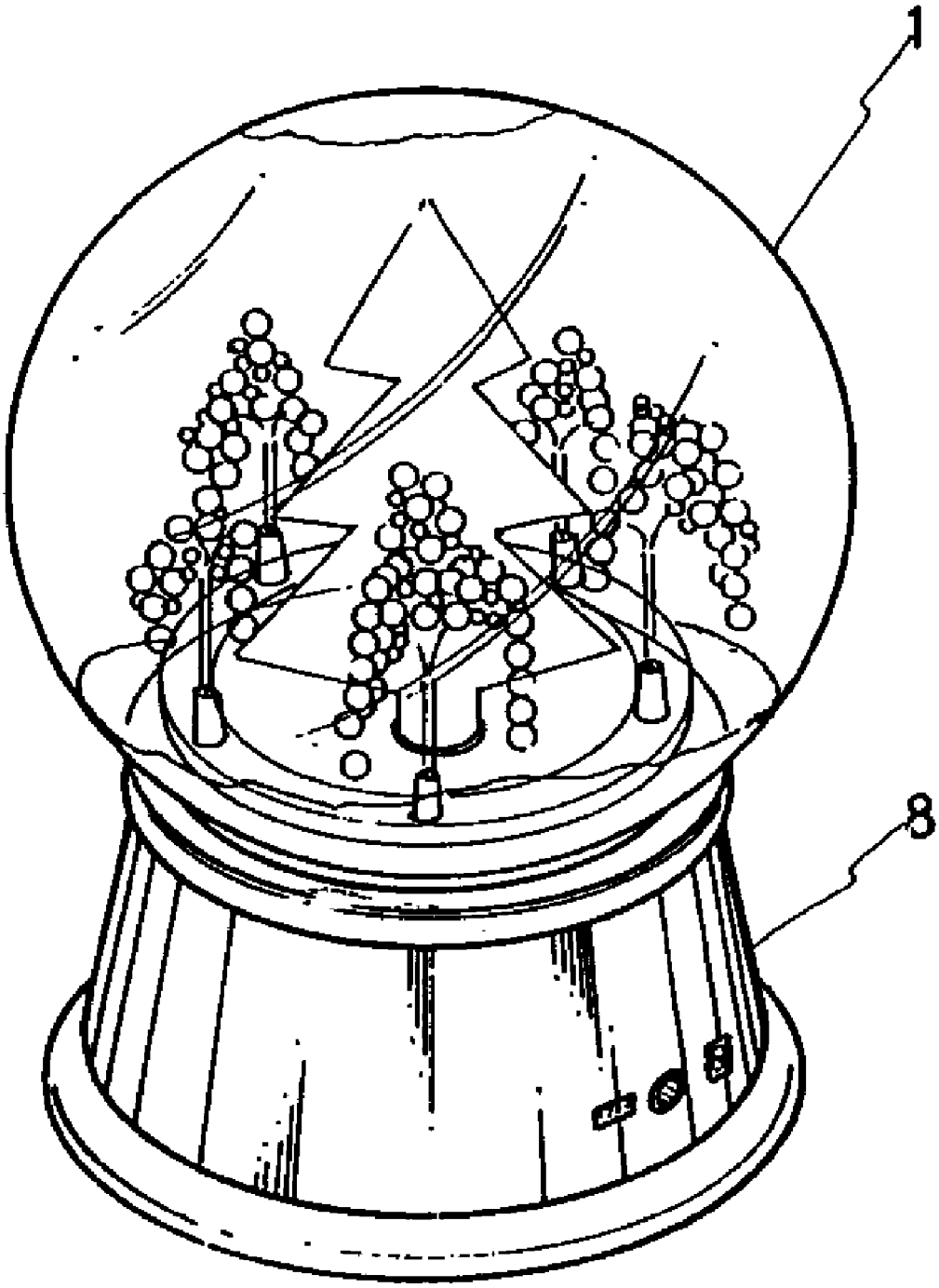
FIG. 1 is a perspective view of the preferred embodiment of the present invention.
Figure 2:
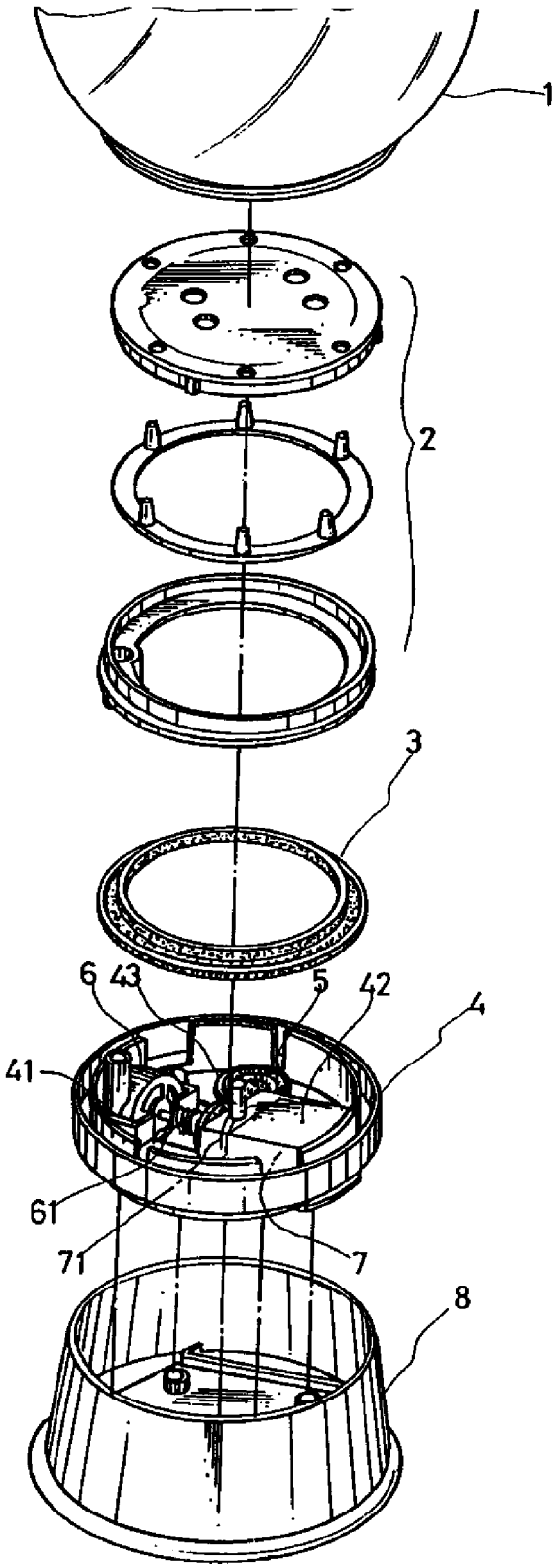
FIG. 2 is a schematic exploded view of the preferred embodiment of the present invention.

Referring to FIGS. 1 and 2, the water ball structure of the present invention comprises a water ball 1, interior mechanical component 2, an anti-leakage rubber rim 3, a holding seat 4, a deformation rubber body 5, a water pump 6, a motor 7 and a base seat 8. The unique feature of the present invention is on the relationship between the deformable rubber body 5 and the water ball holding seat 4. In accordance with the present invention, the anti-leakage rubber rim 3 is mounted to the water ball 1 and is then sealed such that the water ball contains liquid of different relative density and colors and the liquid will not leak out from the water ball.

The water pump 6 is positioned on the depression or slot 41 of the holding seat 4 and at one lateral side of the holding seat 4, corresponding to the slot 41, there is a protruded cavity 42 for holding the motor 7. The water pump 6 is at the bottom of the interior of the water ball 1, and the motor 7 is at the bottom of the exterior of the water ball 1. The two components are attracted to each other by ways of magnetic coupling of the magnetic-coupling plates 61, 71 such that the ball is rotated.

Figure 3:
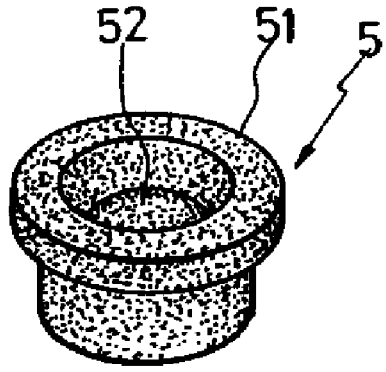
FIG. 3 is a perspective view of the deformable rubber body of the present invention.
Figure 4:
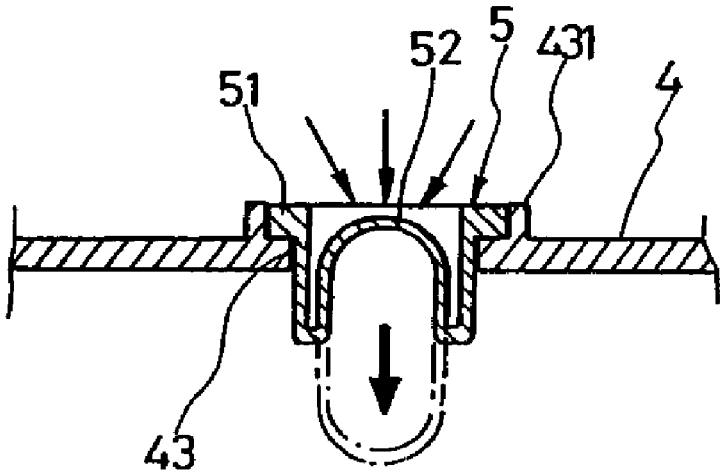
FIG. 4 is a sectional view of the deformable rubber body and the engaging slot in accordance with the present invention.
Figure 5:
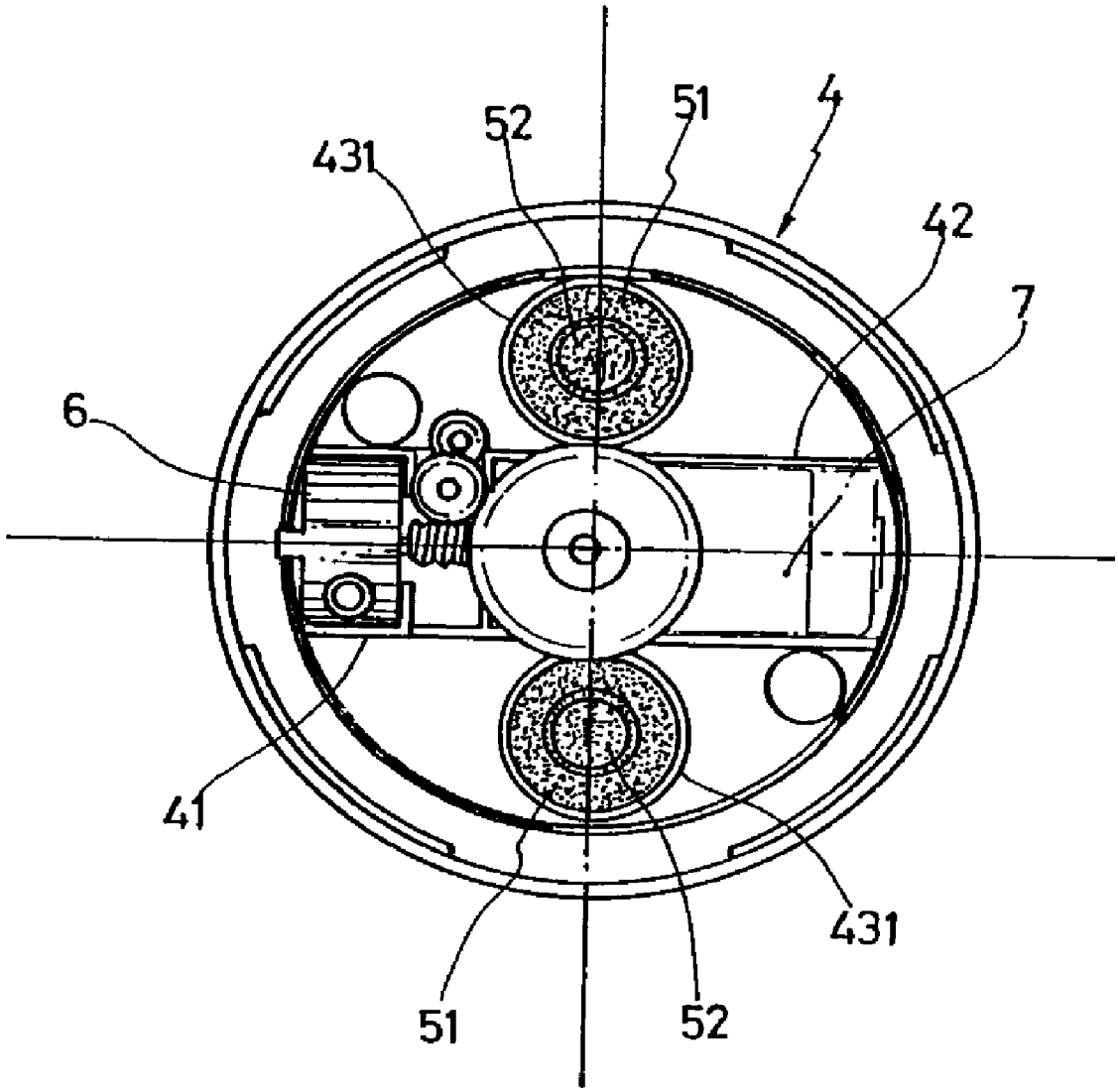
FIG. 5 is a schematic view of the holding seat in accordance with the present invention.

As shown in FIGS. 3 and 5, the holding seat 4 is provided with engaging slot 43 corresponding to the number of deformable rubber body 5 for the fastening of the deformable rubber body 5 such that each deformable rubber ball 5 evenly receives the pressure exerted by the liquid contained in the water ball 1. The deformable rubber body 5 is made from rubber material and has an engaging top edge 51 to engage with the interior of the protruded edge 431 of the engaging slot 43 such that the rubber body 5 can withstand pressure and sealing. The interior of the deformable rubber body 5 has an integrally formed compressed section 52. The compressed section 52 absorbs or resists the increases or decreases of pressure by the liquid contained in the water ball, as shown in FIG. 4.

When the pressure of the liquid in the water ball 1 increases, the compressed section 52 is will be forced to increase its volume. When the pressure of the liquid in the water ball 1 decreases, the compressed section 52 will restore to its original volume. Thus the water level and the weight of liquid in the water ball are not affected such that the entire water ball is self-operating and self-changing of liquid volume.

In accordance with the present invention, the rubber body 5 is made from rubber material and therefore the rubber ball is highly deformable. Thus, when the liquid of the water ball 1 exceeds a specific pressure, the ball is expandable and therefore the ball will not leak.

The engagement of the deformable rubber body 5 can be adhered onto the holding seat 4 by using adhesion such that the engagement is secured and leakage proof.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A Water ball structure comprising a water ball, interior mechanical component arranged within said water ball, an anti-leakage rubber rim engaged with a bottom of said water ball and sealed, a holding seat mounted under the anti-leakage rubber rim and having a slot and a protruded cavity, a water pump positioned in said slot, a motor received in said protruded cavity, and a base seat mounted under said holding seat, the improvement wherein said holding seat has an engaging slot provided with a protruded edge, a deformation rubber body is engaged with said engaging slot and has an integrally formed compressed section which will increase in volume when pressure of liquid in said water ball increases and will decrease in volume when pressure of liquid in said water ball decreases thereby preventing water leakage.

* * * * *